US007300394B2

(12) United States Patent
Buhl et al.

(10) Patent No.: US 7,300,394 B2
(45) Date of Patent: Nov. 27, 2007

(54) METHOD AND DEVICE FOR PRODUCING A FILTER ROD

(75) Inventors: Alexander Buhl, Robertsdorf (DE); Sönke Horn, Geesthacht (DE); Irene Maurer, Hamburg (DE); Jan Peisker, Schulendorf (DE); Thorsten Scherbarth, Geesthacht (DE); Stephan Wolff, Glinde (DE); Jann De Boer, Hamburg (DE)

(73) Assignee: Hauni Maschinenbau AG, Hamburg (DE)

( * ) Notice: Subject to any disclaimer, the term of this patent is extended or adjusted under 35 U.S.C. 154(b) by 252 days.

(21) Appl. No.: 10/926,075

(22) Filed: Aug. 26, 2004

(65) Prior Publication Data

US 2005/0049128 A1 Mar. 3, 2005

(30) Foreign Application Priority Data

Sep. 3, 2003 (EP) ..... 03019976

(51) Int. Cl.
*B31C 13/00* (2006.01)
*A24B 3/14* (2006.01)
*A24C 5/18* (2006.01)

(52) U.S. Cl. ..... 493/46; 493/39; 493/49; 493/68

(58) Field of Classification Search ..... 493/39, 493/43, 49, 68; 264/DIG. 48; 131/31, 288, 131/62, 66.1
See application file for complete search history.

(56) References Cited

U.S. PATENT DOCUMENTS 2,796,810 A 6/1957 Muller
3,050,430 A 8/1962 Gallagher
3,444,863 A 5/1969 Soehngen et al.
3,704,192 A 11/1972 Soehngen et al.
4,104,431 A * 8/1978 Luke ..... 428/211.1
4,180,536 A 12/1979 Howell, Jr. et al.
4,282,890 A 8/1981 Howell, Jr. et al.
4,357,379 A * 11/1982 Sloan et al. ..... 428/113
4,409,995 A * 10/1983 Nichols ..... 131/84.1
4,501,579 A * 2/1985 Boegli et al. ..... 493/45
4,541,826 A * 9/1985 Warner ..... 493/48
4,575,368 A * 3/1986 Sagawa et al. ..... 493/49
4,936,920 A * 6/1990 Keritsis et al. ..... 131/77
5,025,815 A * 6/1991 Hill et al. ..... 131/332
5,156,169 A * 10/1992 Holmes et al. ..... 131/60
5,509,430 A * 4/1996 Berger ..... 131/341
5,620,641 A * 4/1997 Berger ..... 264/103
6,568,399 B1 * 5/2003 Wieczorek et al. ..... 131/90
2003/0213496 A1 * 11/2003 Wolff et al. ..... 131/341

(Continued)

FOREIGN PATENT DOCUMENTS

DE 1692901 12/1971

(Continued)

*Primary Examiner*—Thanh K. Truong
*Assistant Examiner*—Gloria R. Weeks
(74) *Attorney, Agent, or Firm*—Greenblum & Bernstein, P.L.C.

(57) ABSTRACT

Method and device for producing a filter rod. The method includes melting at least one first type of filter material, pressing the at least one first type of filter material through at least one nozzle, depositing the at least one first type of filter material on a conveying element, and shaping the filter rod on the conveying element. The instant abstract is neither intended to define the invention disclosed in this specification nor intended to limit the scope of the invention in any way.

19 Claims, 5 Drawing Sheets

U.S. PATENT DOCUMENTS

| | | | | |
|---|---|---|---|---|
| 2004/0097354 | A1* | 5/2004 | Yamashita et al. | 493/39 |
| 2004/0177857 | A1* | 9/2004 | Nakanishi et al. | 131/370 |
| 2005/0000530 | A1* | 1/2005 | Snaidr et al. | 131/334 |

FOREIGN PATENT DOCUMENTS

| | | |
|---|---|---|
| EP | 0861036 | 9/1998 |
| FR | 1499016 | 9/1967 |
| GB | 1100727 | 1/1968 |

* cited by examiner

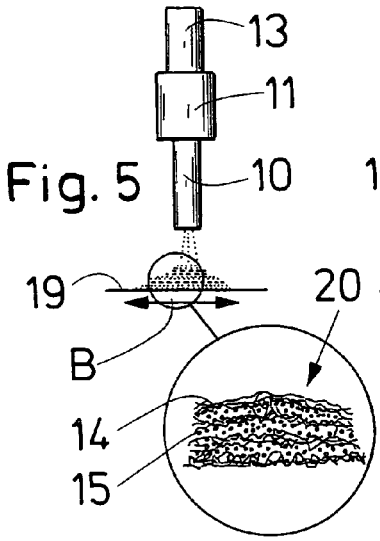
Fig. 5
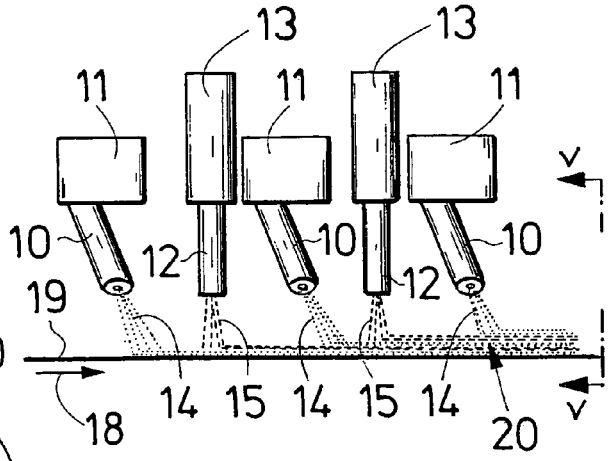
Fig 4
Fig. 6
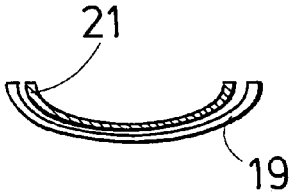
Fig. 7a
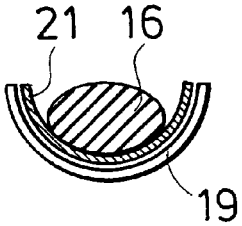
Fig. 7b
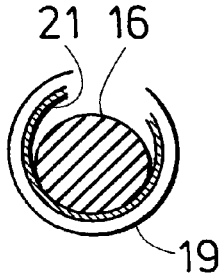
Fig. 7c
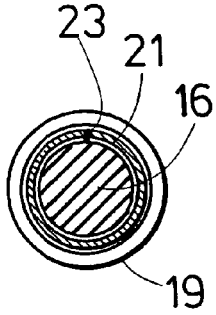
Fig. 7d
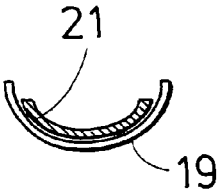
Fig. 8a
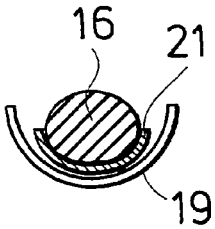
Fig. 8b
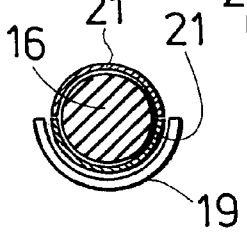
Fig. 8c
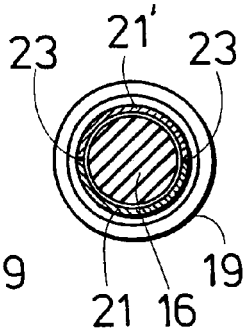
Fig. 8d

METHOD AND DEVICE FOR PRODUCING A FILTER ROD

CROSS-REFERENCE TO RELATED APPLICATIONS

The present application claims priority under 35 U.S.C. § 119 of European Patent Application No. 03 019 976.4, filed on Sep. 3, 2003, the disclosure of which is expressly incorporated by reference herein in its entirety.

BACKGROUND OF THE INVENTION

1. Field of the Invention

The invention relates to a method for producing a filter rod of the tobacco processing industry comprising at least one filter material. The invention also relates to a device for producing a filter rod of the tobacco processing industry comprising a conveying element onto which filter material can be deposited and a rod shaping device for forming a filter rod from the filter material, wherein the conveying element extends into the rod shaping device.

2. Discussion of Background Information

A corresponding method and a corresponding device are known from DE-OS-1 692 901. A method for producing tobacco smoke filters is described in which substantially continuous filament material is produced by spray spinning, which material is conveyed against a continuously moving collecting surface arranged at an angle to the spray path, wherein an elongated strip of randomly arranged filament segments is formed and parts of the strip are moved laterally relatively to one another so that a continuous filter rod is formed therefrom. After the spinning, various additives can be added to the filament material according to known methods. As filament material, cellulose acetate filaments or filaments of polyethylene and polypropylene can be used.

SUMMARY OF THE INVENTION

The present invention provides a generic method and a generic device with which filter rods with high quality can be produced effectively.

The invention provides a method for producing a filter rod of the tobacco processing industry that includes at least one filter material. The process includes melting at least one first type of filter material, pressing the at least one first type of filter material through at least one nozzle, depositing the at least one first type of filter material in the form of fibers on a conveying element, and shaping the filter rod by conveying the filter material on the conveying element through a shaping device.

Due to the pressing of the at least one first type of filter material through at least one nozzle, after the filter material has been melted or plasticized, i.e. made sufficiently soft, corresponding filaments form that are thrown onto the conveying element. This results in a corresponding crimping of the filaments pressed out of the nozzle. The pressing from the nozzle can also be an extruding. On the way to the conveying element and preferably still on the conveying element, the filaments are correspondingly sticky or still plasticized such that they adhere or stick to one another at contact points or crossing points of the corresponding filaments. This results in a very efficient filter rod with very good filter properties in high quality. In a particularly preferred embodiment of the method according to the invention, the at least one first type of filter material is pressed through the at least one nozzle by compressed air. The crimping effect of the filter material filaments being formed can be increased by this. In addition, an efficient filter rod production is provided in that the filter filaments of the at least one first type of filter material are deposited on a conveying element that itself shortly thereafter transports the filter material through a shaping device, so that the process parameters can be set without difficulties such that the filter material is still plasticized during the shaping of the filter rod. Due to this, only a little or no additional energy is needed during the shaping.

The filter properties are distinctly improved if at least one second type of filter material in the form of pellets, granular material, and/or powder is fed to the at least one first type of filter material subsequent to the pressing out from the at least one nozzle. The second type of filter material can be, for example, activated carbon granular material or activated carbon powder or activated carbon pellets. However, flavorings or other additives can also be used.

If the at least one second type of filter material is fed to the at least one first type of filter material at a point in time at which the first type of filter material enables an adhering of the second type of filter material, a secure joining of the different filter materials is possible. It is particularly preferred here to feed the second type of filter material to the first type of filter material at a point in time at which the first type of filter material has not yet struck the conveying element. This results in a very thorough intermixing of the filter materials, by which the quality, in particular the homogeneity, of the filter rod is improved.

A particularly effective production of a filter rod with a wrapper material strip is possible when the at least one first type of filter material is deposited on a wrapper material strip deposited on the conveying element. The wrapper material strip is preferably porous, so that air can pass through it. The conveying element is also preferably porous, so that suction air can act on the filter materials through the conveying element and if necessary the wrapper material strip, in order to guarantee a secure joining of the filter materials.

If first a layer of the at least one first type of filter material is deposited, a wrapper material strip can be avoided or a filter rod or a filter can be generated that features in the outermost layer only a filter material or a type of filter material.

If subsequently further filter material is deposited on the layer, such as for example a mixture of a first type and a second type of filter material, the filter properties can be improved. This is even more true when the further filter material comprises at least partially the second type of filter material. It is for example possible to use a very high proportion of pellets or granular material and/or powder. Granular material proportions of over 90% by wt can be achieved.

If the deposited layer features a width adequate for wrapping the further filter material, the deposited layer can replace a wrapper material strip. Preferably in the shaping device the deposited layer is wound around the further filter material.

Alternatively, if subsequently a layer of the at least one first type of filter material is deposited, as a result of which the further filter material is substantially wrapped completely by the layers, another possibility for wrapping the further filter material by layers of the at least one first type of filter material is possible. Preferably the layers and if necessary the layers with the further filter material are joined together in the shaping device. This takes place preferably by adding heat and corresponding pressure, which already acts on the filter material by the shaping.

Preferably the at least one second type of filter material is fed to the at least one first type of filter material on the way from the at least one nozzle to the conveying element. In an alternative to this, the at least one second type of filter material is fed to the at least one first type of filter material after the first type of filter material has been deposited on the conveying element.

When filter material of the first and/or second types is deposited repeatedly behind one another in the conveying direction of the conveying element, a kind of filter material sandwich or a multiple structure of filter material can be generated.

The first type of filter material is understood in particular to mean filter materials such as cellulose acetate, polyethylene, polypropylene, nylon, polybutadiene (PBT), polycarbonate (PC), hot glue, which is known per se in the tobacco processing industry or the packaging of products of the tobacco processing industry, and also biodegradable polymers made from mixtures with starch.

The invention also provides a device for producing a filter rod of the tobacco processing industry that includes a conveying element onto which filter material can be deposited and a rod shaping device for forming a filter rod from the filter material. The conveying element extends into the rod shaping device, and at least one nozzle is provided through which liquefied or plasticized filter material of at least one first type can be deposited on the conveying element.

Through the device according to the invention it is possible to produce filter rods effectively and with very good filter properties and high quality. A wrapper material strip is preferably arranged between the conveying element and the filter material. If a pair of nozzles are provided in each case that are partially directed towards one another, an increased crimping and also interlocking of the filaments of the filter material exiting from the nozzles arises. Preferably several nozzles are provided one behind the other in the conveying direction of the conveying element, by which a very thorough intermixing or interlocking of the filaments of filter material arises. If at least one feed device is provided for at least one second type of filter material, the filter properties can be distinctly improved. Preferably at least one feed device is embodied in order to convey the filter material of the second type onto a jet of filter material of the at least one first type exiting from the nozzles. In this manner, the thorough intermixing of the filter materials of the first and the second type is increased. Preferably the rod shaping device can be heated and/or cooled at least partially.

A method for producing a cigarette filter comprising a method for producing a filter rod of the tobacco processing industry that was described above, provides that the cigarette filter is cut to length from the produced filter rod.

The present invention is directed to a method for producing a filter rod. The method includes melting at least one first type of filter material, pressing the at least one first type of filter material through at least one nozzle, depositing the at least one first type of filter material on a conveying element, and shaping the filter rod on the conveying element.

According to a feature of the invention, the filter rod can be a rod of the tobacco processing industry.

In accordance with another feature, the at least one first type filter material may be deposited in the form of fibers.

According to still another feature of the instant invention, the filter rod may be shaped by conveying the filter material through a shaping device.

The method can further include feeding at least one second type of filter material to the at least one first type of filter material. The feeding of the at least one second type of filter material can occur subsequently to the pressing out from the at least one nozzle. Further, the at least one second type of filter material comprises at least one of pellets, granular material, and powder.

According to the invention, the feeding of the at least one second type of filter material occurs at a point in time at which the second type filter material adheres to the first type of filter material.

In accordance with a further feature of the invention, the at least one first type of filter material can be deposited on a wrapper material strip arranged on the conveying element.

Moreover, the at least one first type of filter material can be deposited on the conveying element forms a layer. The process can then include subsequently depositing further filter material on the layer, where the further filter material can be at least partially composed of at least one of pellets, granular material, and powder. The layer may be deposited with a width sufficient to wrap the further filter material. Further, the deposited layer may be wound around the further filter material in the shaping device.

The method can also include forming a second layer separate from the layer, and joining the layer to the second layer in such a manner that the layer and second layer wrap the further filter material. The layer and second layer can be joined together in the shaping device.

Still further, the method can include feeding at least one second type of filter material to the at least one first type of filter material as it travels from the at least one nozzle to the conveying element.

The method may also include feeding at least one second type of filter material to the at least one first type of filter material after the first type of filter material has been deposited on the conveying element.

In accordance with the invention, the method may also include repeatedly depositing the at least one first type of filter material through nozzles successively arranged in the conveying direction.

Moreover, the method can include repeatedly feeding at least one second type of filter material through nozzles successively arranged in the conveying direction. The at least one first type filter material and the at least one second type of filter material can be alternately deposited.

The present invention is directed to a device for producing a filter rod. The device includes a conveying element arranged to receive deposited filter material, and a shaping device structured and arranged to form a rod. The conveying element is arranged to extend into the rod shaping device. At least one nozzle is structured and arranged to deposit at least one of a liquefied or plasticized filter material of at least one first type on the conveying element.

According to a feature of the invention, the filter rod can be a rod of the tobacco processing industry.

In accordance with another feature of the present invention, the filter rod can be composed of filter material of at least one first type.

Further, a wrapper material strip can be arranged between the conveying element and the filter material of the at least one first type.

The at least one nozzle may include at least a pair of nozzles oriented to be at least partially directed towards one another.

According to still another feature of the instant invention, the at least one nozzle can include several nozzles successively arranged one behind the other in a conveying direction.

The device can also include at least one feed device structured to feed at least one second type of filter material. The at least one feed device can be positioned to convey the filter material of the second type onto the filter material of the at least one first type exiting from the at least one nozzle.

In accordance with still yet another feature of the present invention, the rod shaping device can be structured to be at least one of at least partially heated and cooled.

The invention is directed to a method for producing a cigarette filter in accordance with the above-noted method and includes cutting the cigarette filter to length from the filter rod.

The present invention is directed to a method for producing a cigarette filter in a device as described above that includes cutting the cigarette filter to length form the filter rod.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein:

FIG. 4 illustrates a diagrammatic representation of a further embodiment of a part of a device according to the invention in front view;

FIG. 5 illustrates a diagrammatic sectional representation along the section V-V from FIG. 4;

FIG. 6 illustrates an enlarged diagrammatic representation of a cut-out from FIG. 5;

FIG. 7*a* illustrates a diagrammatic representation of a section through the rod assembly zone at the start of the rod assembly;

FIG. 7*b* illustrates a corresponding diagrammatic sectional representation according to 7*a* wherein the section is shown downstream of the rod production;

FIG. 7*c* illustrates a sectional representation according to FIG. 7*b* farther downstream;

FIG. 7*d* illustrates a sectional representation according to FIG. 7*c* farther downstream;

FIG. 8*a* illustrates a diagrammatic representation of a section corresponding to FIG. 7*a* in another embodiment;

FIG. 8*b* illustrates a diagrammatic representation of a section corresponding to FIG. 7*b* in another embodiment;

FIG. 8*c* illustrates a diagrammatic sectional representation corresponding to FIG. 7*c* in another embodiment;

FIG. 8*d* illustrates a diagrammatic sectional representation corresponding to FIG. 7*d* in another embodiment;

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
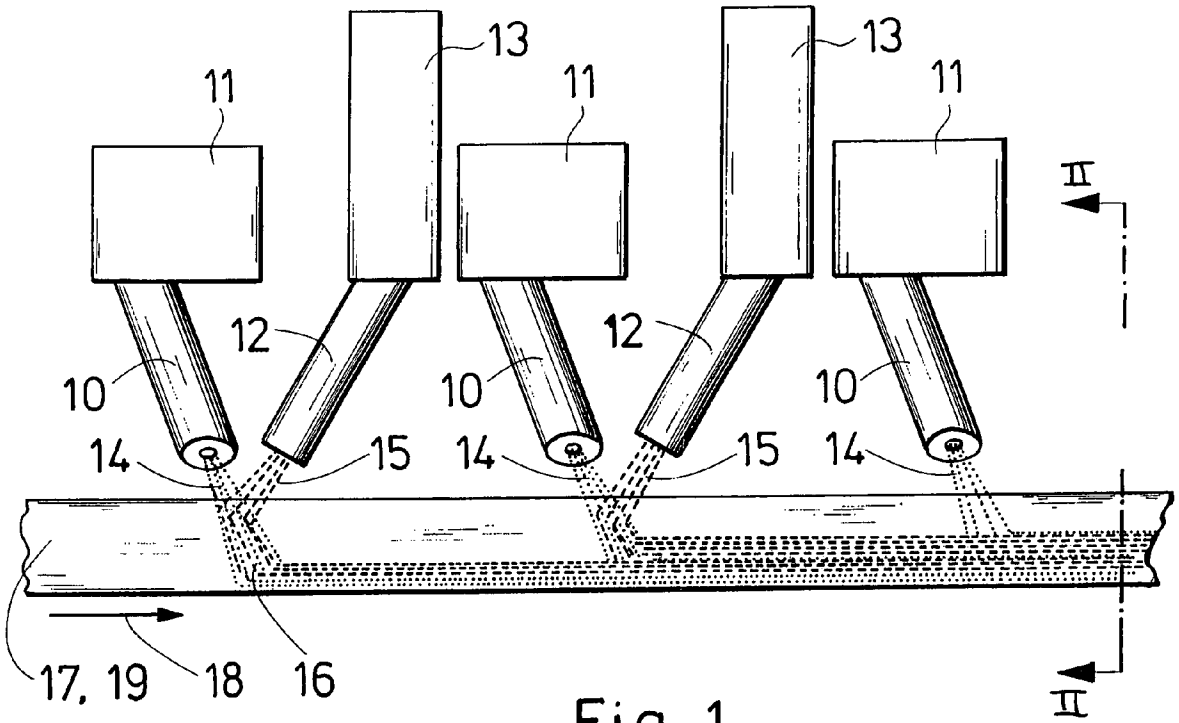
FIG. 1 illustrates a diagrammatic front view of a part of a device according to the invention.

FIG. 1 shows a diagrammatic representation of a part of a rod maker according to the invention or a device for producing a filter rod of the tobacco processing industry in front view. From corresponding supply containers, such as for example a hot glue supply 11, which can also be designated as a hot melt adhesive supply 11, hot glue is discharged under pressure via a nozzle 10 and is fed to a wrapper material 17 or a garniture belt 19. Instead of a hot melt adhesive or hot glue 14, which is known in the tobacco processing industry or in the packaging industry for tobacco products, other materials can also be used such as polypropylene, polyethylene, cellulose acetate, propylene carbonate, or polycarbonates based on bisphenol A carboxylic acid esters, nylon, and biodegradable polymers made from mixtures with starch. After exiting from the nozzle 10, these materials, hot glue 14 or hot melt adhesive in the exemplary embodiment of FIG. 1, or as another example biodegradable polymers made from a mixture with starch or the just-named materials, are present in the form of filaments and are deposited correspondingly crimped, due to adequate pressure, on the wrapper material 17 or the garniture belt 19.

In order to improve the filter properties, a granular material 15 from the granular material supply 13 is introduced directly into the hot glue fibers 14 or the hot glue filaments 14 via feed pipes 12. This results in a very thorough intermixing of the two filter materials hot glue 14 and granular material 15. The corresponding fibers or filaments that exit from the nozzles 10 are still correspondingly sticky or adhesive on the way to the wrapper material 17 or the garniture belt 19, so that the further filter materials, namely for example the granular material 15 and also other filaments, stick together or adhere to one another. This results in a secure joining of the corresponding filter materials. In the exemplary embodiment of FIG. 1, three nozzles 10 are provided and two feed pipes 12, so that an adequate amount of filter material is applied on the wrapper material strip 17 or the garniture belt 19 in a short time. As a result a high production speed can be achieved. The garniture belt 19 moves in the conveying direction 18 in the direction of a shaping support, not shown in FIG. 1.

Figure 2:
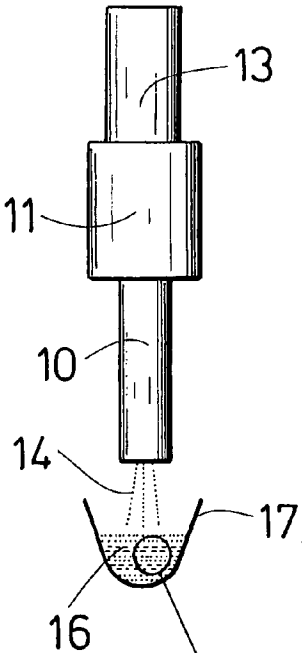
FIG. 2 illustrates a diagrammatic side view along the section II-II of FIG. 1.
Figure 3:
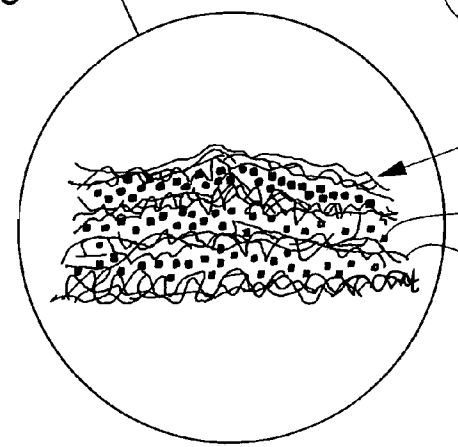
FIG. 3 illustrates an enlarged diagrammatic representation of a cut-out from FIG. 2.

FIG. 2 shows a sectional representation in the direction of the section II-II in a diagrammatic representation. In this sectional representation the shape of the wrapper material 17 or the garniture belt 19 is shown in more detail. If a wrapper material 17 were used, it would rest on the garniture belt 19 in a manner known per se. An enlarged representation of the mixture 16 is shown in FIG. 3, in which granular material 15 and hot glue filaments 14 that are crimped can be recognized.

FIGS. 4 through 6 show another embodiment of a part of a rod maker according to the invention. In this exemplary embodiment on the one hand the garniture belt 19 is embodied flat as long as the corresponding filter material is being applied. Only downstream in the conveying direction is the garniture belt then shaped correspondingly in a garniture device in order to generate a filter rod. In the exemplary embodiment of FIG. 4 through FIG. 6, hot glue filaments 14 and granular material 15 are applied alternately, where the outer layers are made of corresponding filaments. This results in a type of sandwich structure. The first layer of hot glue filaments is applied over a width B. The width B is sufficient to be wound around the entire further applied filter material. The width B then corresponds to at least $2\pi r$, where r is the radius of the filter rod to be produced.

A corresponding application of filter material, which takes place successively in a certain way, is shown in FIGS. 7*a*) through 7*d*). First a layer 21 in the form of a fibrous web made of corresponding hot glue fibers 14 is applied onto the garniture belt 19. During the application of this layer, suction air is conducted through it over the entire area of the garniture belt 19, so that the hot glue filaments 14 that form the fibrous web 21 are held on the garniture belt 19. After the fibrous web 21 has been produced, a mixture of hot glue filaments 14 and granular material 15 is applied into or onto the fibrous web 21. At this point only the central part of the garniture belt 19 is acted upon with suction air, so that the corresponding mixture 16 accumulates only in a partial area. Then the filter material is brought by garniture belt 19 into a shaping device in which the fibrous web 21 and the garniture belt 19 are wound around the mixture 16. Finally, after the fibrous web 21 has been wound completely around the mixture 16, it is joined at the seam 23 by heating and thus the fibrous web 21 is correspondingly closed.

Another embodiment is shown in FIGS. 8*a*) through 8*d*). In this case the wrapping of the mixture 16 takes place with two fibrous webs 21 and 21', wherein first a fibrous web 21 is generated, then the mixture 16 is brought into the fibrous web 21 and then a type of cover is applied onto the mixture in the form of a fibrous web 21'. In the shaping device, which is not shown, the two seam points 23 are then joined together by the action of heat.

The fiber rod that is generated in these exemplary embodiments (according to FIGS. 6 through 8) can excel in its particularly high proportions of granular material. Furthermore the filter elements that are cut to length from the produced fiber rod manage without a separate wrapping material, according to the exemplary embodiments of FIGS. 6 through 8. The granular material is correspondingly held by fibers.

Through the nozzles 10 or spinnerets of a spinneret head 27 (FIG. 9 or 13), a filament or a fiber is produced correspondingly. A spinneret head 27 that is preferably used bears the designation Summit System of the Nordson company.

Figure 9:
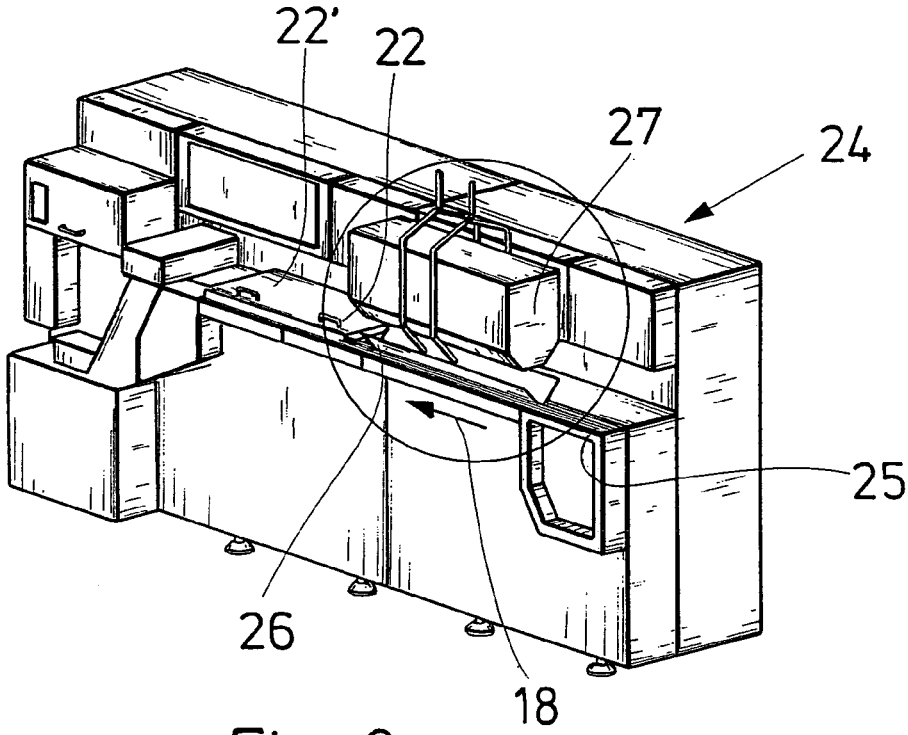
FIG. 9 illustrates a diagrammatic three-dimensional representation of a rod maker (rod-making machine) according to the invention.
Figure 13:
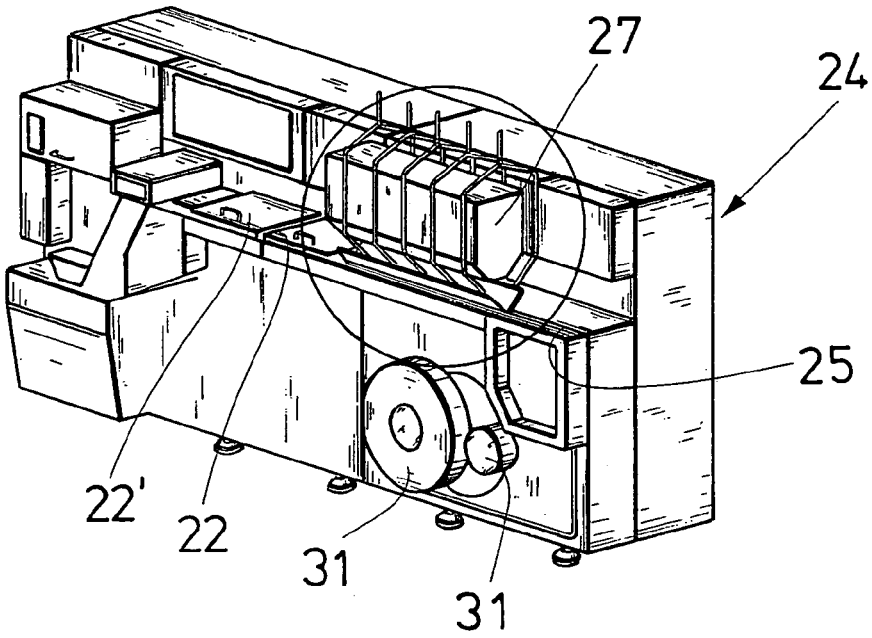
FIG. 13 illustrates a diagrammatic three-dimensional representation of another embodiment of a rod maker according to the invention.

From the granular material feed pipes 12, granular material 15 is blown together with fibers onto a garniture belt 19 that can be embodied as a suction belt, so that the granular material and the still slightly sticky filaments of the thermoplastic material join together. In this connection the garniture belt 19 moves in the direction of a rod shaping device 22, 22' (FIG. 9 or 13). In the rod shaping device the rod is first heated and then cooled, in order to define the rod shape plastically. In this manner a wrapping paper or a wrapper material 17 can be omitted. Optionally after an addition of granular material/fiber a pure fiber layer can again be applied, in order to wrap the rod in its entirety with a fiber layer.

The rod shaping, which is indicated diagrammatically in FIGS. 7*d*) and 8*d*), preferably takes place by heating and subsequent cooling. As already partially shown, corresponding materials are all possible resins and polymers such as PP, PE, PBT, nylon, PC, CA, hot glue, as well as biodegradable polymers made from mixtures with starch. As far as the corresponding materials are concerned, reference is made to EP 0 861 036 B1 in its entirety. All the materials named there are to be included in the disclosure of this application in their entirety. The mixture 16 preferably comprises between 80 and 95% by wt (percent by weight) of activated carbon granular material or activated carbon powder or activated carbon pellets and 5 to 20% by wt of a fiber of one or more types of a thermoplastic material (resin or polymer). The pellets or granular materials or powders are present in a size of preferably 50 μm to 4 mm. The fibers exiting from the nozzles 10 can be discontinuous or continuous. It is also possible to produce pure fiber filters made from the named materials. These can be composed of one type of fibers or of various types of fibers.

FIG. 9 shows a diagrammatic three-dimensional representation of a rod maker 24 according to the invention. From the spinneret head 27, which comprises several nozzles, as shown for example in FIGS. 11 and 12, wherein several nozzles can also be arranged one behind the other in the conveying direction 18, hot glue 14 is correspondingly heated and conveyed through the corresponding nozzles into the funnel 26 and is applied onto a garniture belt 19 or a wrapper material 17 arranged on a garniture belt 19, wherein the garniture belt 19 is guided in a guide 25 in the lower area of the funnel 26 (cf. FIG. 12). In the central area of the spinneret head 27, viewed in the conveying direction, two granular material feeds 28 are provided that end in feed tubes 12, through which correspondingly granular material or pellets or powder is fed to the hot glue fibers placed on the garniture belt 19. Subsequent to the feeding of filter material, a garniture 22 or 22' follows, where first the filter rod is shaped in a heating part 22, in order then to cure the filter rod in a cooling part of the garniture 22'.

Figure 10:
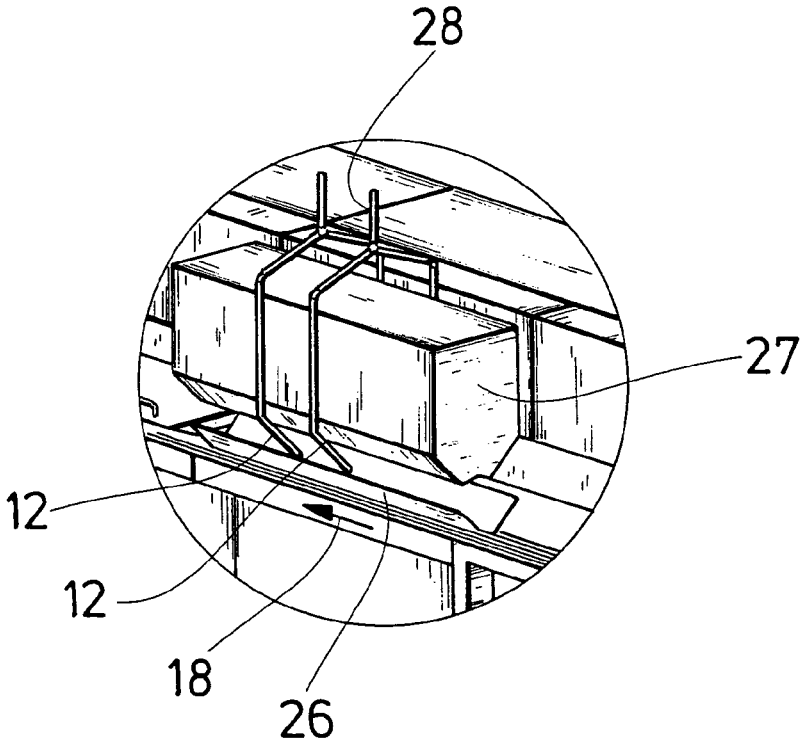
FIG. 10 illustrates a cut-out of the rod maker according to the invention from FIG. 9 in an enlarged representation.

FIG. 10 shows an enlarged representation of a part of FIG. 9.

Figure 11:
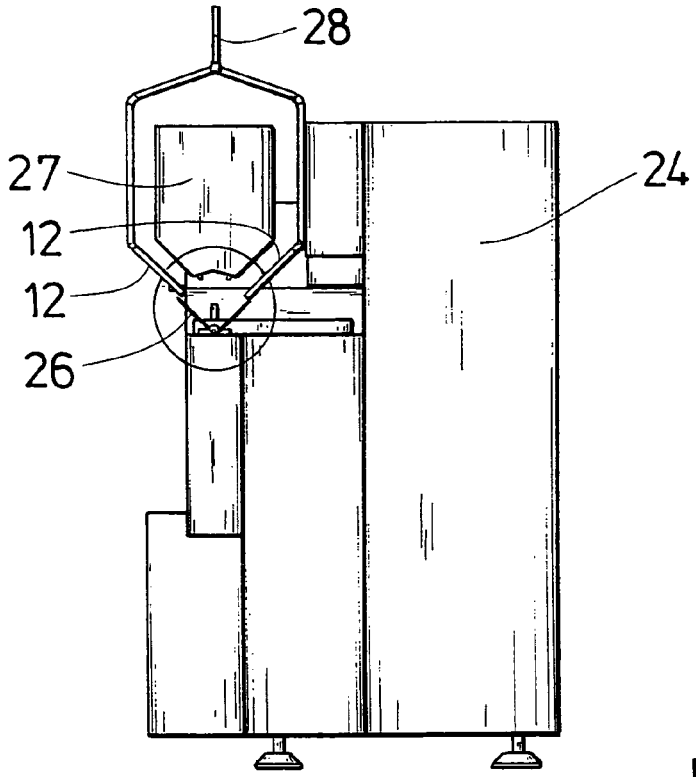
FIG. 11 illustrates a diagrammatic side view of the rod maker from FIG. 9.
Figure 12:
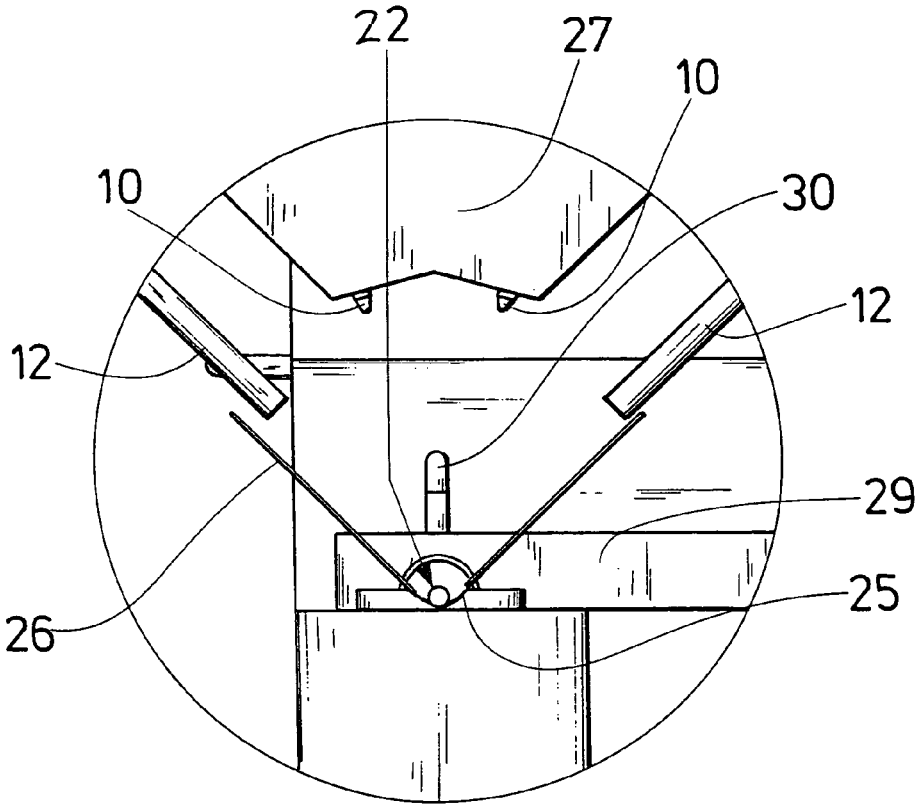
FIG. 12 illustrates a diagrammatic representation of a cut-out from FIG. 11 in enlargement.

FIG. 11 shows a side view of FIG. 9 in diagrammatic representation, wherein the nozzles 10 are more distinctly visible and also the rod assembly area. These can be recognized most distinctly in FIG. 12, which is an enlarged representation from FIG. 11. In FIG. 12 the garniture cover 29 with a corresponding handle 30 is also shown in more detail. The garniture 22, through which the corresponding filter rod, which is not shown, is guided, is also shown in FIG. 12.

FIG. 13 shows another embodiment of a rod maker 24 according to the invention, wherein several, namely in this exemplary embodiment 5, granular material feeds 28 are provided, so that an improved intermixing of the granular material with the corresponding hot glue fibers or fibers of another thermoplastic material is possible. In this exemplary embodiment (FIG. 13 and FIG. 14) it is preferred to use a wrapping material or wrapper material 17, which is indicated by corresponding bobbins 31. In this exemplary embodiment of FIG. 13, the garniture is also embodied separately as far as the heating part 22 and the cooling part 22' are concerned.

Figure 14:
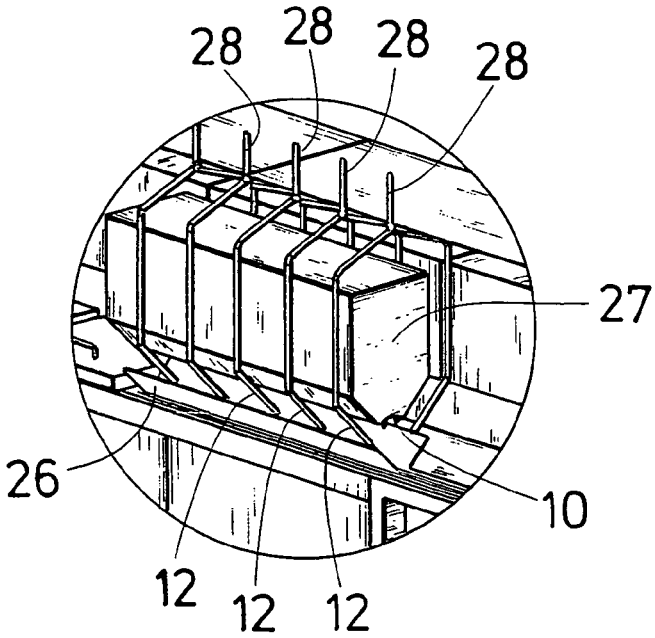
FIG. 14 illustrates a cut-out from FIG. 13 in enlarged representation.

FIG. 14 shows an enlarged representation of a cut-out of FIG. 13 for better illustration.

The substantial advantages of the method according to the invention and the device according to the invention are due to an adhesive-free joining of fibers and granular material or of fibers alone. A very large amount of granular material is possible relative to the fibers. Furthermore the diameters of the fibers or filaments produced can be varied by a simple exchange of the corresponding nozzles 10 or spinnerets on the spinneret head 27. It is possible to mix polymers correspondingly in order to achieve improved fiber properties. Furthermore storage is simplified, since fibers can be stockpiled in the form of granular materials and not in the form of balls, so that less volume is needed for the storage.

Preferably the temperatures and the conveying speeds are set so that at the place where the knives are provided in order to cut the filter rod to filter rod length or to cut it off, the fiber rod is correspondingly already cooled adequately. Furthermore high rod speeds are possible. Further materials such as for example flavors and fillers etc. can also be added to the filter rod in a simple way. Furthermore in a particularly preferred exemplary embodiment no separate wrapping material is necessary.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made within the purview of the appended claims, as presently stated and as amended, without departing from the scope and spirit of the present invention in its aspects. Although the present invention has been described here in with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE NUMBERS

10 Nozzle
11 Hot glue
13 Feed pipe
14 Granular material supply
14 Hot glue
15 Granular material
16 Mixture
17 Wrapper material
18 Conveying direction
19 Garniture belt
20 Filter material sandwich
21, 21' Fibrous web
22 Garniture, heating part
22' Garniture, cooling part
23 Seam
24 Rod maker
25 Guide
26 Funnel
27 Spinneret head
28 Granular material feed
29 Garniture cover
30 Handle
31 Bobbin
B Width

What is claimed:

1. A method for producing a filter rod, comprising:
melting at least one first type of filter material;
pressing the at least one first type of filter material through at least one nozzle;
depositing the at least one first type of filter material on a conveying element; and
shaping the filter rod by conveying filter material including the at least one first type of filter material on the conveying element through a shaping device; and
repeatedly depositing the at least one first type of filter material through nozzles successively arranged in the conveying direction.

2. The method in accordance with claim 1, wherein the filter rod is a rod of the tobacco processing industry.

3. The method in accordance with claim 1, wherein the at least one first type filter material is deposited in the form of fibers.

4. The method in accordance with claim 1, further comprising feeding at least one second type of filter material to the at least one first type of filter material.

5. The method in accordance with claim 4, wherein the feeding of the at least one second of filter material occurs subsequently to the pressing out from the at least one nozzle.

6. The method in accordance with claim 4, wherein the at least one second type of filter material comprises at least one of pellets, granular material, and powder.

7. The method in accordance with claim 4, wherein the feeding of the at least one second type of filter material occurs at a point in time at which the second type filter material adheres to the first type of filter material.

8. The method in accordance with claim 1, wherein the at least one first type of filter material is deposited on a wrapper material strip arranged on the conveying element.

9. The method in accordance with claim 1, wherein the at least one first type of filter material deposited on the conveying element forms a layer.

10. The method in accordance with claim 9, further comprising subsequently depositing further filter material on the layer.

11. The method in accordance with claim 10, wherein the further filter material is at least partially composed of at least one of pellets, granular material, and powder.

12. The method in accordance with claim 10, wherein the layer is deposited with a width sufficient to wrap the further material.

13. The method in accordance with claim 10, wherein the deposited layer is wound around the further filter material in the shaping device.

14. The method in accordance with claim 10, further comprising:
forming a second layer separate from the layer; and
joining the layer to the second layer in such a manner that the layer and second layer wrap the further filter material.

15. The method in accordance with claim 14, wherein the layer and second layer are joined together in the shaping device.

16. The method in accordance with claim 1, further comprising feeding at least one second type of filter material to the at least one first type of filter material as the at least one first type of filter material travels from the at least one nozzle to the conveying element.

17. The method in accordance with claim 1, further comprising feeding at least one second type of filter material to the at least one first type of filter material after the first type of filter material has been deposited on the conveying element.

18. The method in accordance with claim 1, further comprising repeatedly feeding at least one second type of filter material through nozzles successively arranged in the conveying direction, wherein the at least one first type filter material and the at least one second type of filter material are alternately deposited.

19. A method for producing a cigarette filter in accordance with claim 1, comprising cutting the cigarette filter to length from the filter rod.

* * * * *